United States Patent [19]

Caci et al.

[11] Patent Number: 4,814,776

[45] Date of Patent: Mar. 21, 1989

[54] OPTIMALLY GROUNDED SMALL LOOP ANTENNA

[75] Inventors: Joseph D. Caci, Lantana; Lorenzo A. Ponce de Leon, Lake Worth, both of Fla.

[73] Assignee: Motorola, Inc., Schaumburg, Ill.

[21] Appl. No.: 95,300

[22] Filed: Sep. 10, 1987

[51] Int. Cl.[4] ..... H01Q 1/24

[52] U.S. Cl. ..... 343/702; 343/748

[58] Field of Search ..... 343/702, 718, 722, 741, 343/744, 748, 850; 455/338

[56] References Cited

U.S. PATENT DOCUMENTS

| | | | |
|---|---|---|---|
| 3,736,591 | 5/1973 | Rennels et al. | 343/702 |
| 4,123,756 | 10/1978 | Nagata et al. | 343/702 |
| 4,491,978 | 1/1985 | Nagata et al. | 455/338 |

OTHER PUBLICATIONS

Motorola Publication No. 68P1005C65, Issue A, published 8/27/76, entitled "Pageboy II FM Radio Pager, A04FNC Series", copyright 1974 to Motorola, Inc.

*Primary Examiner*—William L. Sikes
*Assistant Examiner*—B. Randolph
*Attorney, Agent, or Firm*—Vincent B. Ingrassia; Anthony J. Sarli, Jr.; Donald B. Southard

[57] ABSTRACT

A small closed loop antenna is formed by a flat metal member formed into a U-shape which also serves as the front, back and top surfaces, or parts thereof, of the housing for a portable communications receiver. Connected to the open (bottom) end of the arms is an isolation network providing an optimum antenna ground and a reactance network which applies a capacitive reactance across the antenna and isolation network so that the conductive member forms an antenna that detects the H-field of the electromagnetic wave to be received. The reactance network is tunable to adjust the antenna for reception at particular frequencies.

15 Claims, 4 Drawing Sheets

-PRIOR ART-

-PRIOR ART-

-PRIOR ART-

-PRIOR ART-

OPTIMALLY GROUNDED SMALL LOOP ANTENNA

FIELD OF THE INVENTION

This invention relates to antennas for use in portable communications receivers, and more particularly, to small loop antennas suitable for use at UHF frequencies which enclose a substantial portion of the reactive circuitry.

BACKGROUND OF THE INVENTION

Portable communications receivers, such as pagers, have utilized numerous antenna designs for signal reception. The antenna configuration utilized is a function of performance and space or size requirements. One example of an antenna that provided excellent antenna performance within certain frequency ranges while minimizing size requirements is shown in FIGS. 1 and 2. As shown in these figures, the antenna developed had a small loop antenna which enclosed the entire receiver circuitry. Additional features provided were cosmetic appeal and a rugged means of clip attachment in a minimum amount of space. The loop antenna shown in FIGS. 1 and 2 is described in detail in U.S. Pat. No. 3,736,591 to Rennels et al. entitled "Receiving Antenna for Miniature Radio Receiver", which is assigned to the assignee of the present invention.

While the performance of the small loop antenna of Rennels et al. has been excellent when utilized within the frequency range of 148 to 174 MHz, the antenna performance is substantially reduced when the antenna is utilized at higher frequencies, such as in the UHF frequency range from 450 to 512 MHz.

It has been discovered that since one end of the small loop antenna has been terminated at the ground potential, coupling existed between the antenna to the enclosed receiver ground plane and components of the receiver which were also grounded via stray capacitance. This stray capacitance has been distributed along the complete length of the loop and can effectively short out sections of the antenna at high frequencies, thereby substantially degrading the antenna's performance. Several attempts have been made to overcome this problem, achieving only limited success.

One attempt is shown in FIG. 3. FIG. 3 was previously used in a Pageboy II paging receiver manufactured under Motorola's designation A04FNC2468AN. In this case, the end of the loop antenna which was previously grounded was disconnected or floated from receiver ground, terminating the antenna at a potential other than ground. The resultant stray capacitance provided the return path for the loop antenna. While an improvement in sensitivity was obtainable for the particular antenna configuration, it was noted that as the antenna was brought closer to the ground plane, or as the size of the antenna loop was reduced, the improvement obtained was correspondingly reduced. Consequently, it was possible to obtain little to no improvement in antenna sensitivity compared to grounding one end of the loop antenna when the antenna was a small loop size and/or was in close proximity to the ground plane.

Another attempt to solve this problem was disclosed in U.S. Pat. No. 4,491,978 to Nagata entitled "Portable Radio Receiver with High Antenna Gain." As shown in FIG. 4 from Nagata, the loop antenna and high conversion circuits were isolated from the balance of the receiver by use of high impedance elements Z placed in the ground, power supply and signal lines. It was indicated that an increase in antenna gain was obtainable. However, this solution required three components to obtain an improvement, and the effect of circuit layout on achieving the improvement was indeterminate.

SUMMARY OF THE INVENTION

It is an object of this invention to provide a small loop antenna substantially enclosing a receiver having improved antenna performance when operated at high frequencies, such as in the UHF frequency range.

It is a further object of this invention to provide a small loop antenna substantially enclosing a receiver which is insensitive to loop size and package constraints.

The antenna of the invention is formed by a flat metal cover formed into a U-shape which also serves as two opposite sides and one end, or parts thereof, of the housing for a portable communications receiver. Connected to the open (bottom) end of the arms is an isolation network providing an optimum antenna ground and a reactance network which applies a capacitive reactance across the antenna and isolation network so that the conducting cover forms an antenna that detects the H-field of the electromagnetic wave to be received. The reactance network is tunable to adjust the antenna for reception at a particular frequency.

In an alternate embodiment of the invention, the flat, conductive U-shaped member may be mounted within the housing, thereby concealing the antenna from view and improving the cosmetic appearance of the receiver.

BRIEF DESCRIPTION OF THE DRAWINGS

The features of the invention which are believed to be novel are set forth with particularity in the appended claims. The invention itself, together with its further objects and advantages thereof, may be understood by reference to the following description when taken in conjunction with the accompanying drawings, in the several figures of which like reference numerals identify identical elements, in which:

DESCRIPTION OF THE PREFERRED EMBODIMENT

Figure 5:
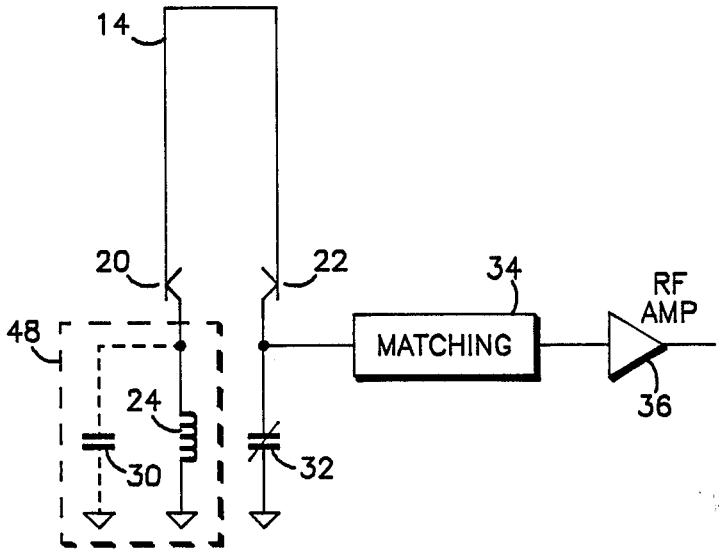
FIG. 5 is a schematic diagram of a small closed loop antenna for a preferred embodiment of the present invention.

Reference is directed to FIG. 5 which shows a schematic diagram of the preferred embodiment of the present invention. A loop antenna 14 is terminated on one end to a contact 20. Contact 20 is preferably made of sheet metal, such as beryllium copper, and suitably plated with a metal, such as gold, to provide good electrical conductivity. An inductor 24 connects to contact 20 and to the receiver ground, unlike that of FIGS. 1–4. The opposite end of loop antenna 14 terminates to a contact 22 made substantially the same as contact 20. A reactance means comprising variable capacitor 32 and matching network 34 couples to contact 22, applying a capacitive reactance across the antenna. The opposite end of variable capacitor 32 couples to the receiver ground. Variable capacitor 32 provides a means for tuning loop antenna 14. The signals picked up by the antenna are derived from the reactance means and delivered to the output of matching network 34 which couples to the input of RF amplifier 36. The design of matching network 34 and RF amplifier 36 are well known to one of ordinary skill in the art.

Figure 6:
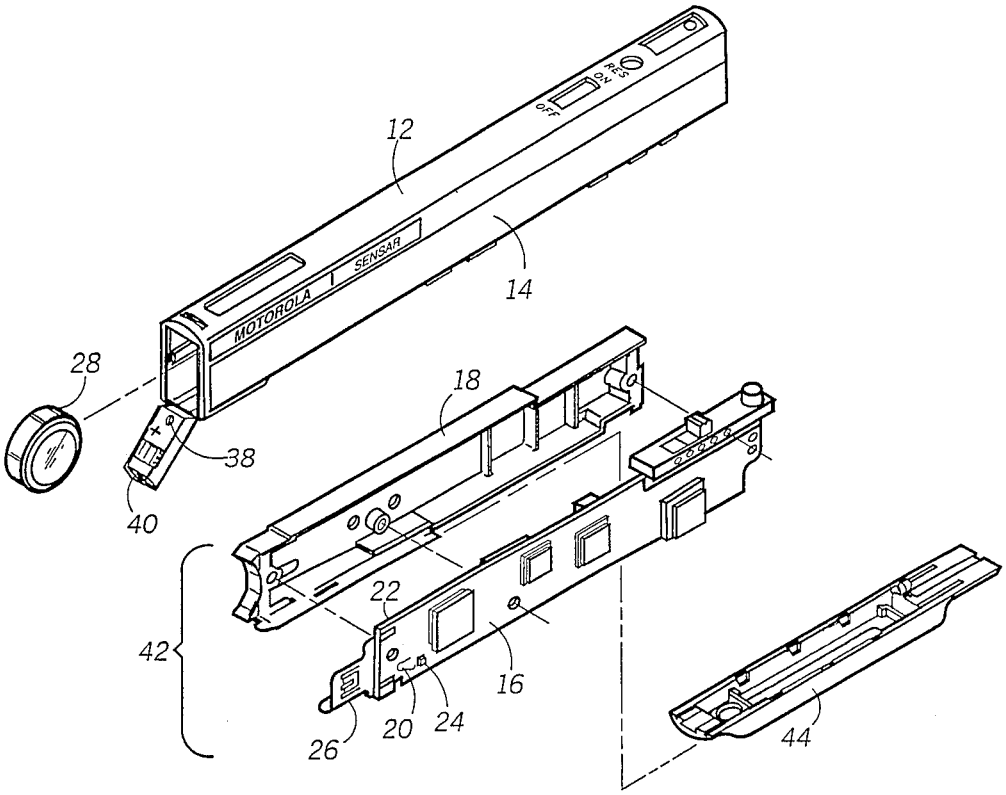
FIG. 6 illustrates a construction for the preferred embodiment of the present invention.

Reference is now directed to FIG. 6 which shows an exploded view of the construction of the closed loop antenna of the present invention in a paging receiver. While the present invention is disclosed hereinafter with particular reference to a paging receiver, it is to be understood at the outset of the description which follows it is contemplated that the apparatus and methods, in accordance with the present invention, may be used with numerous other communication receiving systems. A housing 12 molded from a durable plastic material, such as a polycarbonate plastic, is provided. A loop antenna 14 made from a flat conductive material, such as beryllium copper, is suitably plated to protect the base material and to provide stable electrical contact for antenna contacts 20 and 22. Loop antenna 14 is formed in a U-shaped configuration having two elongated substantially parallel arms connected by a substantially shorter connecting portion. In the preferred embodiment, the length of the elongated arms are 5.30 inch, the length of the connecting portion is 0.42 inches, and the width is 0.40 inches. Loop antenna 14 includes several tabs (not shown) which are used to secure loop antenna 14 to housing 12. In operation, the U-shaped conductive member forms an inductive loop antenna which is responsive to the H-field component of the electromagnetic wave at the receiver operating frequency.

A printed circuit board 16 is provided for interconnecting and supporting all electrical components for the receiver and associated circuits, such as a decoder, alerting circuit, etc. A frame 18, also made from a plastic, such as polycarbonate, is used to rigidize printed circuit board 16 and properly locate the completed receiver assembly 42 into housing 12. An LCD display assembly 44 is also connected to and is a part of completed receiver assembly 42. Antenna contacts 20 and 22 are attached to printed circuit board 16 on opposite sides of the board. When receiver assembly 42 is assembled into housing 12 through the side of housing 12, openings are provided in the walls of housing 12 to allow connection of antenna contacts 20 and 22 with antenna 14. Inductor 24 is located adjacent contact 20, as well as the matching network 34 and RF amplifier 36, both of which are not specifically shown.

Inductor 24 also provides a D.C. path to ground which allows battery 28 to be charged by connecting a negative charger contact to antenna 14 while connecting a positive charger contact through hole 38 in battery door 40, allowing direct contact with the positive battery terminal.

As shown in FIG. 6, loop antenna 14 encloses a substantial portion of printed circuit board 16 when receiver assembly 42 is assembled into housing 12. As a consequence, a substantial coupling between grounded receiver components and the ground plane and the antenna is obtained. While the preferred embodiment of the present invention is described as being external to the housing, it will also be appreciated by one skilled in the art that any loop antenna formed from a flat conductive member that encloses a portion of the receiver circuit, and is located internal to and concealed by the housing, will also function in a manner, and be susceptible to the problems described herein. It will also be appreciated that the loop antenna need not be manufactured from a single continuous sheet of flat material as described, but may be manufactured from multiple segments connected to the receiver board to form a single loop antenna. Interconnection of the segments may be permanent, such as by soldering, or temporary, such as by plug-in contacts.

Figure 7:
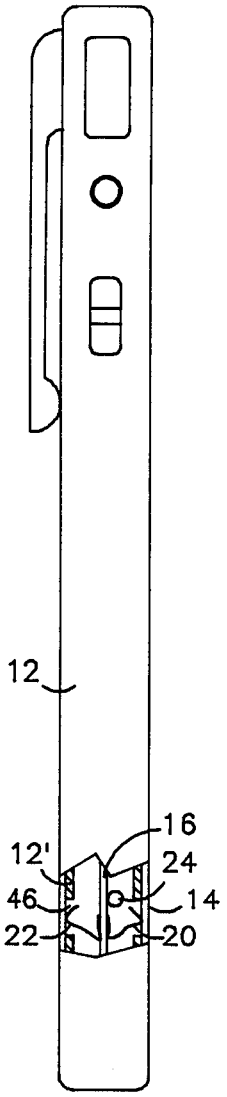
FIG. 7 shows a sectional view of the preferred embodiment of the present invention.

Reference is now directed to FIG. 7 which shows a partial sectional detail through housing 12. As shown, antenna 14 is affixed to housing 12 as previously described. Openings 46 in housing walls 12' allows connection of antenna contacts 20 and 22 which are spring biased to engage the inside surface of antenna 14 at a point near the bottom of each elongated arm. The relative proximity of antenna 14 to receiver assembly 42 is apparent from this view.

In the preferred embodiment of the present invention, inductor 24 is chosen to be parallel resonant at the receiver operating frequency with the equivalent capacitance of a capacitor 30 which is the stray capacitance present at negative antenna contact 20. Inductor 24 is chosen to be high Q, such as obtainable with an air wound inductor, so as to minimize loading of antenna 14. When inductor 24 is parallel resonant with capacitance 30, forming isolation means 48 shown in FIG. 5, antenna 14 is optimally grounded. Isolation means 48 makes use of the stray capacitance problem that previously degraded receiver performance. As a result, antenna 14 is isolated from these sources of coupling. In order to optimize the tuning of isolation means 48, it may also be required to place a physical capacitor across inductor 24. The value of this capacitor is selected to achieve parallel resonance with the stray capacitance present in the circuit.

An RF choke may be substituted for inductor 24, however, it has been found that RF chokes provide increased loss at higher frequencies, and consequently, the sensitivity improvement is reduced compared to an air wound or other high Q inductor.

Figure 1:
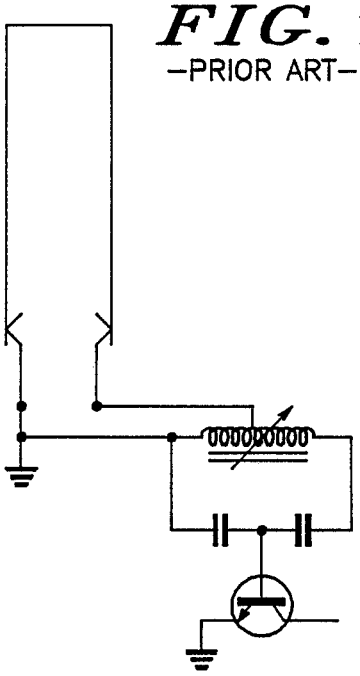
FIG. 1 shows a schematic diagram of an antenna design which completely encloses the receiver circuit.
Figure 2:
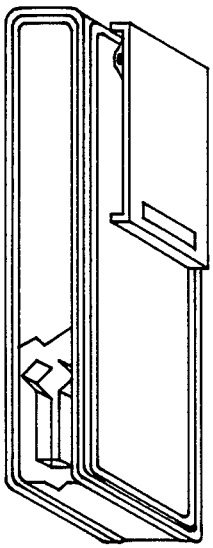
FIG. 2 shows an illustration of a pager utilizing the electrical circuit of FIG. 1.
Figure 3:
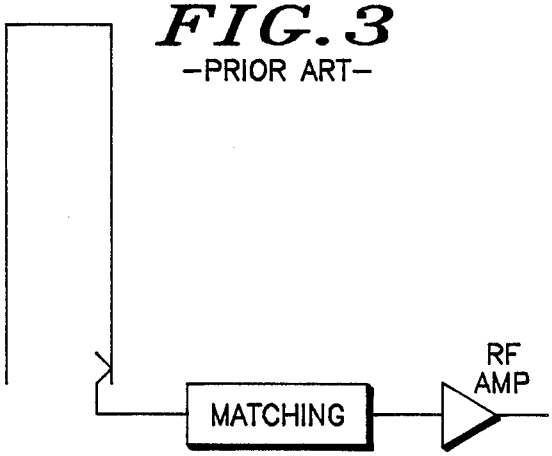
FIG. 3 is a schematic diagram showing a method of coupling a loop antenna.
Figure 4:
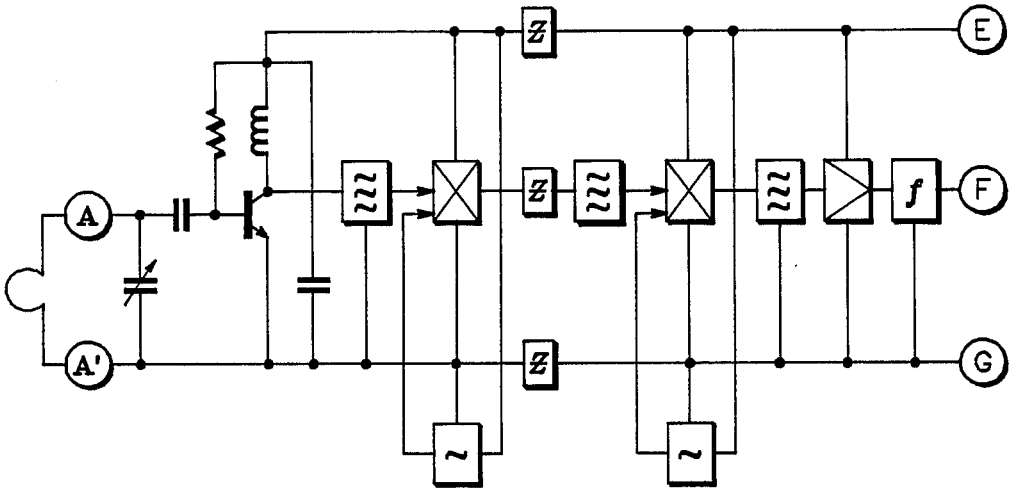
FIG. 4 is a block diagram of a pager showing a method for isolating the antenna from the IF and later sections of the pager.

Measurements for receiver sensitivity for the preferred embodiment indicate at least a 4 dB improvement compared to floating the ground side of the antenna as shown in FIG. 3. A 15 dB improvement is indicated for the preferred embodiment over grounding the loop as shown in FIG. 1. The antenna Q improved from a value of approximately 2 with the antenna grounded directly to a value in excess of 30 with the antenna optimally grounded. The value of inductor 24 can be selected to accommodate the stray capacitance 30 actually present due to receiver board layout and mechanical considerations. Consequently, the present invention is not limited to a particularly mechanical configuration or size of antenna, nor to a particular receiver board layout. The present invention is further not limited by the frequency of operation as with previous antenna designs. The present invention allows the antenna to be external to the receiver housing and isolated from ground at the RF frequency of operation while maintaining a D.C. path to ground suitable for access externally for uses such as charging the battery. Only a single element is required in the present invention to substantially improve the sensitivity of a small loop antenna for operation at high operating frequencies.

We claim:

1. An optimally coupled loop antenna for a miniature portable radio receiver, comprising:

a flat conductive member formed in a U-shaped configuration having first and second elongated substantially parallel arms and a connecting portion connecting said arms, said arms having a length greater than that of said connecting portion, said conductive member forming a part of the housing of the receiver with said arms extending substantially vertical in a normal position of the receiver;

isolation means, coupled between the end of said first arm opposite said connecting portion and a receiver ground; and reactance means, coupled between the end of said second arm opposite said connecting portion and the receiver ground, said reactance means presenting a capacitive reactance across said conductive member and said isolation means.

2. The antenna according to claim 1 wherein said conductive member functions as an inductive loop antenna.

3. The antenna according to claim 1 wherein said reactance means is adjustable to select a value of said capacitive reactance to tune the conductive member for reception of the H-field of an electromagnetic wave.

4. The antenna according to claim 1 wherein said isolation means comprises:

an inductor; and a capacitor in parallel with said inductor and parallel resonant with said inductor at a frequency of operation of the receiver.

5. The antenna according to claim 4 wherein said capacitor is the stray capacitance resultant from coupling between said conductive member and said receiver ground.

6. An optimally coupled loop antenna for a miniature portable radio receiver, comprising:

a flat conductive member formed in a U-shaped configuration having first and second elongated substantially parallel arms and a connecting portion connecting said arms, said conductive member forming a part of the housing of the receiver wherein said arms constitute at least a part of the front and back surfaces and said connecting portion constituting at least a part of the top surface of the housing, said arms of said conductive member extending vertically in a normal position of the receiver;

isolation means, coupled between the end of said first arm opposite said connecting portion and a receiver ground; and reactance means coupled between the end of said second arm opposite to said connecting portion and the receiver ground, for deriving signals therefrom and delivering the signals to said receiver.

7. The antenna according to claim 6 including spring biased contact means engaging said arms at the ends thereof opposite to said connecting portion for making electrical connections between said arms and said isolation means and said reactance network.

8. The antenna according to claim 6 wherein said reactance means is adjustable to select a value of said capacitive reactance to tune the conductive member for reception of the H-field of an electromagnetic wave.

9. The antenna according to claim 6 wherein said isolation means comprises:

an inductor; and a capacitor in parallel with said inductor and parallel resonant with said inductor at a frequency of operation of the receiver.

10. The antenna according to claim 9 wherein said capacitor is the stray capacitance resultant from coupling between said U-shaped conductive member and the receiver ground.

11. An optimally coupled loop antenna for a miniature portable radio receiver having a housing, said antenna comprising:

a flat conductive member formed in a U-shaped configuration having first and second elongated substantially parallel arms and a connecting portion connecting said arms, said arms having a length greater than that of said connecting portion, said conductive member concealed within the housing with said arms extending substantially vertical in a normal position of the receiver;

isolation means, coupled between the end of said first arm opposite said connecting portion and a receiver ground; and reactance means coupled between the end of said second arm opposite to said connecting portion and the receiver ground, said reactance means presenting a capacitive reactance across said conductive member and said isolation means.

12. The antenna according to claim 11 wherein said conductive member functions as an inductive loop antenna.

13. The antenna according to claim 11 wherein said reactance means is adjustable to select a value of said capacitive reactance to tune the conductive member for reception of the H-field of an electromagnetic wave.

14. The antenna according to claim 11 wherein said isolation means comprises:

an inductor; and a capacitor in parallel with said inductor and parallel resonant with said inductor at a frequency of operation of the receiver.

15. The antenna according to claim 14 wherein said capacitor is the stray capacitance resultant from coupling between said conductive member and said receiver ground.

* * * * *